United States Patent [19]

Albright

[11] Patent Number: 4,479,600

[45] Date of Patent: Oct. 30, 1984

[54] APPARATUS FOR AUTOMATED FRAME ASSEMBLY

[75] Inventor: Boland R. Albright, Montgomery, Ala.

[73] Assignee: Duo-Fast Corporation, Franklin Park, Ill.

[21] Appl. No.: 350,312

[22] Filed: Feb. 19, 1982

[51] Int. Cl.[3] ..... B27F 7/02; B42B 3/00; B42B 4/00; B42C 1/12

[52] U.S. Cl. ..... 227/48; 29/432; 29/772; 29/798; 227/148; 156/92; 156/304.5

[58] Field of Search ..... 29/432, 772, 798; 156/92, 304.5; 227/48, 50, 148, 45

[56] References Cited

U.S. PATENT DOCUMENTS

| | | | |
|---|---|---|---|
| 2,456,221 | 12/1948 | Stilwell et al. | 227/45 |
| 2,649,582 | 8/1953 | Paxton | 227/48 |
| 3,606,130 | 9/1971 | DeLamar et al. | 227/45 |
| 4,175,313 | 11/1979 | Neumann | 29/432 X |
| 4,305,538 | 12/1981 | Schultz | 227/48 X |

*Primary Examiner*—Charlie T. Moon
*Attorney, Agent, or Firm*—Mason, Kolehmainen, Rathburn & Wyss

[57] ABSTRACT

A method and apparatus for automated frame assembly, particularly advantageous for use in forming furniture drawers, includes a first bin for storing drawer back portions, situated generally in an elevated position with respect to the rest of the machine, and a pair of opposed bins for storing drawer side portions in serially arranged fashion. A pushing mechanism feeds the drawer back portions one at a time into engagement with one of the serially aligned drawer side portions of each bin. The pushing mechanism, in the same motion, pushes the engaged back and side portions into engagement with a drawer front portion where the side portions are fastened to the drawer front and back portions. Glue is applied to the drawer back portions before they engage the drawer side portions and glue is applied to the drawer side portions before they engage the drawer front portion. The drawer side portion storage bins are automatically refilled when a shortage is detected, by a mechanism which slides a plurality of serially aligned face to face drawer portions into the drawer side portion storage bins. The apparatus is adjustable to produce drawers of different widths and heights and to accept drawer portions of different thicknesses.

10 Claims, 3 Drawing Figures

APPARATUS FOR AUTOMATED FRAME ASSEMBLY

BACKGROUND OF THE INVENTION

1. Field of the Invention

This invention relates generally to methods and apparatus for assembling frames and particularly to the assembly of furniture drawers.

2. Description of the Background Art

A wide variety of machines are well known in the art for assembling generally rectangular wooden frames. These machines usually require the user to assemble the frame with the machine subsequently securing the various assembled frame portions together. For example, some machines require the user to insert a pair of perpendicularly related side portions of the wooden frame into the machine. The machine then butts the two portions together in the proper arrangement and subsequently secures them by stapling or nailing. The user then positions another pair of portions of the frame together to form another corner of the wooden frame and then the various portions are assembled into a completed rectangular frame. Devices of this general type are shown in U.S Pat. Nos. 3,734,381, 3,791,017, and 4,127,226.

In the assembly of drawers for furniture, such as cabinets, dressers and the like, the assembly of the various side, back and front portions into the original unsecured assembly is somewhat more difficult and time consuming than other frame forming operations due to the interfitting relationship of the various pieces. Once the pieces are assembled, manual securement, by stapling or the like, is often as practical as automated stapling machinery.

Many manufacturers of low cost furniture have found, surprisingly, that the assembly of drawers is the most time consuming operation in the assembly of vanities and dressers. Thus, it would be highly desirable to provide an automated drawer assembly apparatus capable of continuous drawer assembly.

SUMMARY OF THE INVENTION

It is a primary object of the present invention to provide a method and apparatus for rapid, automated frame assembly.

It is also an object of the present invention to provide an apparatus capable of assembling the sides, back and front of a drawer into an unsecured assembly and thereafter driving fasteners to fix the various pieces together.

It is still another object of the present invention to provide a method and apparatus for assembling drawers with dovetailed side portions.

It is another object of the present invention to provide an apparatus for assembling drawers capable of manufacturing drawers of different widths, heights and thicknesses.

It is yet another object of the present invention to provide an apparatus with a plurality of storage bins that automatically feed drawer side and back portions one at a time into assembly positions within the apparatus.

It is still another object of the present invention to provide such a machine capable of automatically refilling the side portion storage bins.

It is also an object of the present invention to not only automatically secure the various drawer portions together by fasteners such as nails or staples but also to automatically pre-glue the appropriate drawer portions before securement with fasteners.

These and many other objects of the present invention are achieved by an apparatus for automated drawer assembly including means for supplying the drawer end portions one at a time as well as means for supplying the drawer side portions one at a time. A reciprocating means slides the end portions one at a time into engagement with the side portions and slides the engaged side and end portions into engagement with another end portion. Means are provided for driving fasteners to fix the side portions to the end portions.

In accordance with another embodiment of the present invention a method for automated drawer assembly includes the steps of supplying drawer end portions on a generally continuous basis one at a time and further supplying drawer side portions on a generally continuous basis, one at a time to opposite sides of the end portion. The end portions are slid into engagement with the side portions and the engaged end and side portions are then slid into engagement with another end portion. Thereafter fasteners are driven to secure the side portions to the end portions.

DETAILED DESCRIPTION OF THE PREFERRED EMBODIMENT

Figure 1:
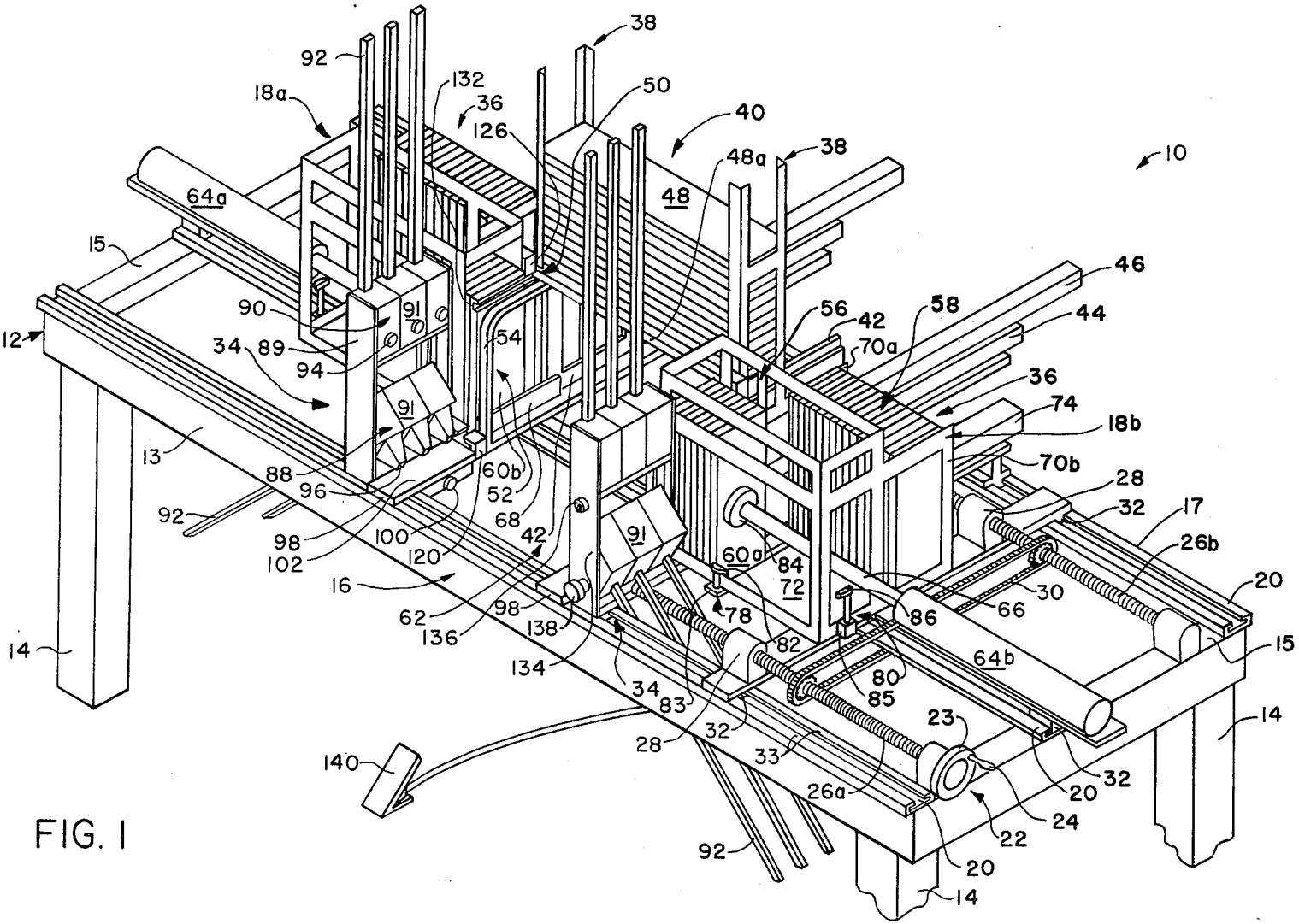
FIG. 1 is a partial, perspective view of one embodiment of the present invention.

Referring to the drawing wherein like reference characters are used for like parts throughout the several views, an automated frame assembly apparatus, shown in FIG. 1, is generally designated by the reference numeral 10. While the apparatus and method are described herein with respect to the manufacture of drawers, it will be obvious to those skilled in the art that the method and apparatus disclosed are also applicable to other frame assembly operations including the formation of window or door frames, and the like. The apparatus 10 is mounted atop a frame 12 on a plurality of legs 14 such that the operator's station 16, located generally centrally along the length of the frame 12, is arranged at waist height. The frame 12 includes a forward edge 13 connected by side edges 15 to a rearward edge 17. A pair of opposed drawer assembly sections 18 are mounted on the frame 12, the section **18*a* being fixed to the frame 12 while the section 18*b* is mounted for sliding movement with respect to the frame 12 on a set of parallel, spaced apart tracks 20**.

Control over the position of the movable section **18*b* is provided by a drive mechanism 22 including a rotatable wheel 23 with a handle 24. Rotation of the wheel 23 threads or unthreads the threaded bars 26 with respect to their threaded receivers 28 resulting in movement of the section 18*b* along the tracks 20. The rotation supplied by the handle 24 is communicated to the threaded bar 26*b* by the chain drive 30. While a screw mechanism has been illustrated as the drive mechanism 22**, those skilled in the art will realize that a wide variety of other mechanisms can be used for this purpose, including a rack and pinion drive mechanism. The section 18*b* is retained within the track 20 by a plurality of truncated triangular sliders 32, retained under the opposed flanges 33 of the track 20 but capable of smooth sliding movement with respect thereto.

Each section 18 includes a fastener driving station 34, a side portion storage bin 36 and a U-shaped back portion support 38, the supports 38 of the sections 18*a* and 18*b* together defining a back portion storage bin 40. In addition each section 18 includes a reciprocating slider 42 mounted for movement across the width of the frame 12 from the rearward edge 17 toward the forward edge 13. Each slider 42 is operated by an extendable cylinder 44, conveniently an air cylinder controlled for constant speed movement by a hydraulic cylinder 46 in a conventional manner.

The back portion storage bin 40 supports a plurality of drawer back portions 48 arranged in a generally serially aligned, face-to-face, vertical stack. The lower front portion of the bin 40 defines a slot 50 which allows only the lowermost portion 48*a* to be slid forwardly out of the bin 40 on the L-shaped rack 52 located intermediately between the sections 18. The rack 52 forms the bottom supporting surface of the back portion storage bin 40 and includes a pair of parallel, spaced apart members 54, each member connected to a different one of the sections 18. Thus, the back portion storage bin 40 enables one by one gravity feeding of the back portions 48 onto the rack 52.

The side portion storage bin 36 on each section 18 includes a pair of chambers 56 and 58, each arranged to hold a plurality of drawer side portions 60 in an upstanding configuration supported on edge, in a generally side by side, serially aligned, vertical configuration. The drawer side portions 60 contained in the chamber 56 are arranged generally parallel to those in the chamber 58; however, the portions 60 in the chamber 58 are situated slightly rearwardly with respect to those in the chamber 56. The portions 60 in each chamber 56 are biased towards the region 62 between the sections 18 by an extendable cylinder 64, conveniently an air actuated cylinder, whose piston arm 66 bears, with constant force, against the last portion 60*a* in the stack of portions 60 in each chamber 56. The cylinder 64*b* used with the movable section 18*b* is mounted on a track 20 for sliding movement with respect to the frame 12. The portions 60 are prevented from flowing inwardly into the region 62 by an upstanding barrier 68 bearing against the first portion 60*b* in the chamber 56.

Figure 3:
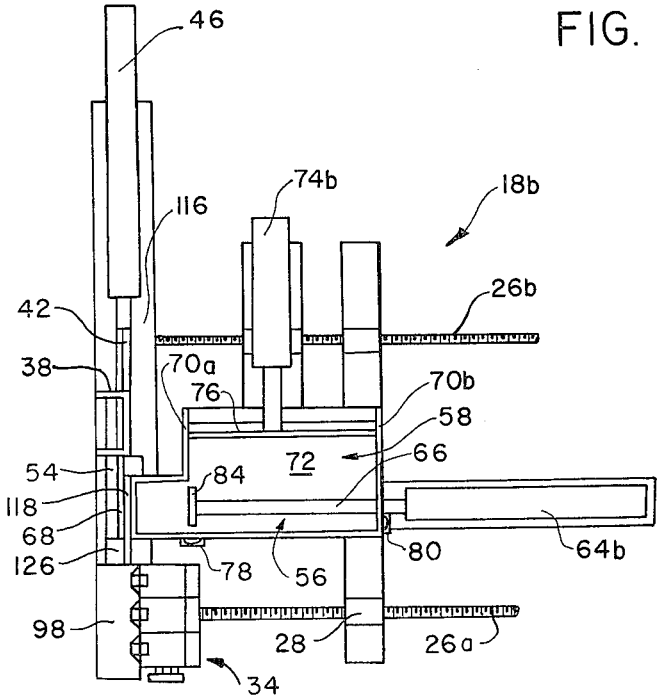
FIG. 3 is a partial, top plan view of the movable drawer assembly section shown in FIG. 1.

Each chamber 58 includes a pair of spaced apart sidewalls 70 and a floor 72 that also forms the lower surface of the chamber 56. An extendable cylinder 74, conveniently an air actuated cylinder, is located along the rearward open side of the chamber 58 and is arranged to push the drawer side portions 60 located therein, inwardly into the chamber 56 through the forward open side of the chamber 58 while the cylinder 64 is retracted. More specifically, as shown in FIG. 3 with respect to the section 18*b*, each cylinder 74 includes an elongated head 76 which spans from one sidewall 70 to the other, arranged, upon extension of the cylinder 74, to slide the portions 60 into the chamber 56. While the cylinder 74*a* used with the section 18*a* is fixed to the frame 12, the cylinder 74*b* used with the section 18*b* is mounted on a track 20 for movement with respect to the frame 12 with the rest of the section 18*b*.

A pair of sensors 78 and 80 are located on two different sides of each chamber 56. The sensor 78 is located along the forward side of the chamber 56, generally aligned with the side 70*a* of the chamber 58 closest to the region 62. The sensor 78 includes a spring mounted, rotatable, cam 82 arranged to be deflected when side portions 60 are present in the adjacent region of the chamber 56. A cam operated, four-way valve 83 is operable from two directions to control the cylinders 74 and 64 in response to the actuation of the cam 82. Thus, when no portions 60 are located immediately adjacent the sensor 78, the sensor cam 82 rotates, under the influence of spring biasing, operating the valve 83 to retract the cylinder 64.

The withdrawal of the cylinder 64 from the chamber 56 is sensed by the sensor 80 located along the side of the chamber 56 farthest from the region 62. The sensor 80 is actuated by the enlarged head 84 of the piston arm 66, signalling the complete retraction of the piston arm 66. Conveniently the sensor 80 includes a conventional flow control valve 85 with a spring biased rotatable cam 86. When the cylinder 64 is retracted sufficiently to operate the sensor 80, the sensor 80 in turn operates the cylinder 74 to slide a plurality of drawer side portions 60 from the chamber 58 into the chamber 56. When these portions 60 are appropriately positioned within the chamber 56, the sensor 78 is again actuated, retracting the cylinder 74 and extending the cylinder 64 until the enlarged head 84 again operates against the rearwardmost drawer side portion 60*a*. The cylinder 64 advantageously operates at a faster speed during withdrawal or retraction than it operates on return to the chamber 56.

Each fastener driving station 34, located on opposite sides of the region 62, includes two banks of fastener drivers 88 and 90, the bank 90 being elevated with respect to the bank 88. The banks 88 and 90 are each conveniently composed of three side by side air actuated nailing or stapling guns 91, typically devices of the kind described in U.S. Pat. No. 3,673,922, to Doyle, assigned to the assignee of the present invention, with extended fastener magazines 92. The guns 91 in the banks 90 are arranged to project nails or staples (not shown) through their mouths 94 in a generally horizontal direction. The fastener drivers 91 forming the banks 88, are arranged to project fasteners such as staples or nails at a 45° angle, and include mouths 96 arranged in a generally downwardly canted orientation. Preferably the openings in the mouths 94 and 96 of one station 34, through which the fasteners exit, are contained in the same vertical plane. Each bank 88 or 90 is vertically adjustable through the slidably adjustable mounting of these banks between the vertical supports 89.

Each fastener driving station 34 also includes a drawer front portion support platform 98. Each platform 98 includes a handle 100 for adjusting the vertical position of the upper surface of the platform 98 with respect to the rest of the apparatus 10 and another means (not shown) for fine adjusting the spacing between the two platforms 98. Preferably the upper surface 102 of each platform 98 is formed of a low friction material such as polyurethane plastic.

Figure 2:
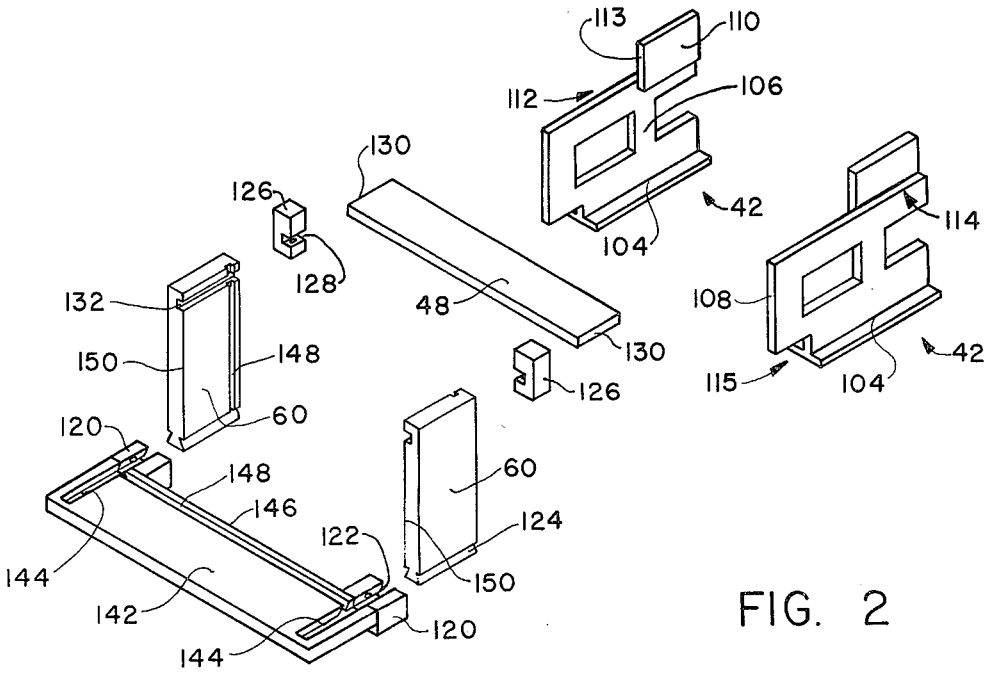
FIG. 2 is a partial, simplified perspective view showing the arrangement of the various drawer portions during assembly in the apparatus shown in FIG. 1.

As shown in FIG. 2, each slider 42 includes a lower, inverted T-shaped track engaging portion 104, a vertically extending frame 106 with a drawer side sliding forward edge 108 and an uppermost generally horizontally disposed drawer back forwarding member 110 secured to the inside of the frame 106. Each member 110 defines an offset 112 extending from the forward edge 108 rearwardly to the vertical forward edge 113 of the member 110. In addition a portion 114 extends rearwardly with respect to the remainder of the slider 42, arranged to maintain the drawer back portions 48 in an upwardly shifted position within the back portion storage bin 40 after the slider 42 has moved forwardly with respect to the storage bin 40. Each track engaging portion 104 includes an offset 115 extending rearwardly from the forward edge 108.

As indicated in FIG. 3, each slider 42 is movable from a rearward position to a forward position adjacent the fastener driving station 34 along a track 116 engaged by the lower track engaging portion 104 of each slider 42. Each track 116 extends along an upstanding barrier 68, adjacent the side of the barrier facing away from the region 62. More importantly, the track 116 is arranged to intersect the forwardmost drawer side portion **60*b* in each chamber 56. Since the forwardmost side portion 60*b* is retained only by compression between its neighboring side portion 60 and the upstanding barrier 68, a gap 118 being defined over the track 116, the slider 42 may contact the rearwardly facing edge of a forwardmost drawer side portion 60*b* and push it forwardly from the chamber 56. In addition the track 116 leads beneath the back portion storage bin 40 such that edge 113 of the horizontally disposed back forwarding member 110 may impact against the lowermost drawer back portion 48*a* located within the bin 40, sliding that portion 48 forwardly along the rack 52. The apparatus 10 is amenable to use with drawer portions of a variety of thicknesses, limited only by the width of the gaps 118 and slot 50**.

A side portion gluing station 120 is located over each track 116 between the platform 98 of the station 34 and the portion of the track 116 adjacent the chamber 56. Each gluing station 120 includes a slot 122 adapted to conform loosely to the lower edge 124 of each side portion 60. Thus, in the illustrated embodiment wherein the drawer side portions 60 have dovetailed lower edges 124, the slots 122 also have a dovetailed configuration. Glue is applied using an air actuated apparatus (not shown) through openings on two sides of the slot 122 to the lower edge 124 of each side portion 60 slid through the gluing station 120.

A back portion gluing station 126 is located on each section 18 between the back portion supports 38 and the adjacent chambers 56 in a position elevated but generally aligned over each track 116. Each station 126 includes an inwardly facing slot 128 arranged to receive a lateral edge region 130 of a back portion 48. When a back portion 48 is slid along the rack 52 through the gluing station 126, glue is applied to the lateral edge region 130 of the portion 48 before the portion is slid into engagement with the side portions 60. Thus, using side portions 60 with dadoed slots 132 for receiving the back portions 48, the slots 128 in the gluing stations 126 are also of a dadoed configuration. This permits glue to be provided on the back portion 48 only as needed to secure the back portion 48 within each of the dadoed slots 132 in the side portions 60. The offsets formed on the sliders 42 by the attachment of the portions 110 to the inside surfaces of the frames 106 enable the sliders 42 to move along the track 116 past the gluing stations 126 while aligned to intercept both the side portions 60 and the back portions 48.

An apparatus control panel 134 is positioned adjacent the operator's station 16, conveniently on the face of one fastener driving station support 89. The panel 134 includes a kill switch 136 and a fastener driver operating switch 138. Thus, the operator can depress the switch 138 firing the various fastener drivers 91 in each bank 88 or 90 in unison. In case of an emergency, the kill switch 136 can be operated to disable all fastener drivers 91 and piston cylinders 44, 64, 74 associated with the apparatus 10. Where the fastener drivers and cylinders are air actuated, the disable function can be accomplished by a valve that opens the air supply line.

Control over the operation of the sliders 42 is provided by a foot actuated switch 140 positioned on the surface upon which the apparatus 10 is supported. Operation of the foot switch 140 moves the sliders 42 forwardly, in unison, at constant speed, to a position adjacent each platform 98 and thereafter automatically retracts them to a position wherein the forward edge 113 of the member 110 is located just rearwardly of the back portion storage bin 40.

The apparatus 10 may be operated in the following manner. Initially a plurality of side portions 60 are arranged in the chambers 56 and 58 with the faces having the dadoed slot 132 facing inwardly toward the region 62, the cylinders 64 being retracted. Thereafter, the position of the movable section **18*b* with respect to the fixed section 18*a* is set by operating the drive mechanism 22 to define the width of the region 62 in accordance with the width of the drawers to be manufactured. After the desired spacing has been set, the appropriately sized back portions 48 are loaded into the back portion storage bin 40, aligned within each support 38 and supported on the rack 52**.

The operator then turns the apparatus 10 "on", operating a source of compressed air (not shown) causing the cylinders 64, of conventional form, to expand until the heads 84 contact the side portions **60*a*. It is entirely permissible to insert within the chambers 56 side portions 60 having a width, measured along the line from the front edge 13 to the rear edge 17, less than the width of the bin 36 measured along the same line. This is because the pressure supplied by the cylinders 64 maintains the portions 60 in alignment. Therefore, side portions 60 of varying widths can be used in the apparatus 10** to produce drawers of a desired height.

A drawer front portion 142, shown in FIG. 2, is positioned by the operator atop the platforms 98 butted against the forward edges of the gluing stations 120. By operating the handle 100 the elevation of each platform 98 can be adjusted to accomodate portions 142 of a desired thickness, the upper surface of the portion 142 being flush with the top surface of the stations 120. The drawer front portions 142 include a pair of spaced apart grooves 144 alignable with the slots 122 in the side portion gluing stations 120 and having a dovetailed configuration when using dovetailed side portions 60. The downward facing side (not shown) of the portion 142 normally forms the exposed surface of the drawer, and is protected from scratching by the upper surfaces 102 of the platforms 98. The operator actuates the foot pedal switch 140 causing the sliders 42 to advance along the track 116 from their rearward position forwardly towards the operator to a forward position adjacent the edge 146 of the drawer front portion 142.

In the course of this movement, the horizontally disposed back forwarding member 110 on each slider 42 contacts the lowermost back portion **48*a* within the storage bin 40 and slides that portion forwardly towards the gluing station 126. More specifically, the forward edge 113 of the member 110 contacts the rearward edge of the lowermost back portion 48*a* sliding it forwardly along the rack 52. The air actuated gluing stations 126** automatically begin to feed glue at the time when a back portion 48 begins to enter the slots 128 and cease to apply glue at the point when the back portion 48 has slid beyond the glue applying station 126. Conveniently the glue application is controlled by trip valves (not shown) located near the rearward edge of each station 126, actuable by the portion 48 to start and stop the glue flow in accordance with the position of the portion 48 with respect to the station 126.

Initially an extra back portion 48 is positioned by the operator on the rack 52, in engagement with the side portions 60. The side portions 60*b* are contacted by the forward edge 108 while the initial back portion 48 is forwarded by the back portion 48*a* being pushed by the leading edge 113 of the member 110. The initial back portion normally must be manually glued since it is inserted in a position forward of the glue stations 126. The portions 60*b* are slid along the tracks 116 guided by the upstanding barriers 68 located along the tracks 116. The dovetailed lower edge 124 of each side portion 60 mates eventually with the dovetailed slot 122 in each gluing station 120 and glue application is automatically initiated as the side portion 60 enters the gluing station 120 and automatically terminated as the side portion 60 extends past the gluing station 120. Again the glue application is controlled by trip valves (not shown) arranged to be actuated by the side portions 60 as they enter and leave the glue stations 120.

A pair of side portions 60, connected by a back portion 48, are slid into the portion 142, the lower edges 124 sliding into the grooves 144 in the front portion 142 in the same motion of each slider 42. This is accomplished by allowing each slider 42 to extend over each gluing station 120, due to the offset 115 in the track engaging portion 104, until the side sliding forward edge 108 is adjacent the rearward edge 146 of the front portion 142. The operator holds the portion 142 against the glue stations 120 during this process. At this point the drawer has been assembled with the exception of the bottom portion (not shown) and the sliders 42 are automatically retracted to their original positions. The assembled drawer is positioned atop the platforms 98 in a configuration rotated 90° from the horizontal arrangement in which the drawer operates in use.

The operator at this time actuates the fastener driver operating switch 138 and 12 nails or staples, in the illustrated embodiment, are automatically driven into the assembled drawer. More specifically, the fastener drivers 91 in the bank 70 project nails or staples in a generally horizontal direction through the side portion 60 at the location of the dadoed slot 132 and into the lateral edges 130 of the back portion 48. At the same time a plurality of fasteners are driven at a 45° angle into the front portion 142, extending inwardly through the dovetailed lower edge 124 of each side portion 60. In this way the drawers are automatically assembled in the desired arrangement and glued and fastened in the same process. The operator then removes the drawer assembly and places it on an appropriate conveyor to proceed to a station (not shown) where the bottoms (not shown) of the drawers are positioned within the bottom engaging slots 148 in conventional fashion.

As soon as the sliders 42 have reached their forwardmost position they automatically retract to their rearwardmost position. When the forwardmost edge 108 has moved past the chamber 56, the next set of side portions 60 snap into the positions formerly occupied by the portions 60*b* and immediately engage within their dadoed slots 132 the back portion 48*a* which was positioned between the chambers 56 in the same motion of the sliders 42 that pushed the side portions 60*b* into the front portion 142. At the end of the rearward movement of the sliders 42, the forward edge 113 passes rearwardly of back portion bin 40 and the lowermost back portion 48 is allowed to drop into position on the rack 52. Therefore when the sliders 42 again move forwardly the process repeats automatically, it no longer being necessary to manually feed and glue an initial back portion 48.

Preferably the width of the back portions 48 is less than the width of the side portions 60 to enable the drawer bottoms to be easily inserted into the slots 148 from the rear of the assembled drawer. The portions 48 are positioned between the slots 148 in each side portion 60 and the side portion forward edges 150. This arrangement is achieved by defining the length of the offset 112 such that a leading back portion 48 is positioned by the following back portion 48, in turn forwarded by the sliders 42, within the dadoed slot 132 between the side portion forward edges 150 and the bottom engaging slots 148 in the side portions 60. When the slider forward edges 108 contact the side portions 60, the engaged side portions 60 and leading back portion 48 are pushed toward the front portion 142 while the following back portion 48 moves into the position between the chambers 56 formerly occupied by the leading back portion 48.

While the present invention has been described with respect to a single preferred embodiment, it will be obvious to those skilled in the art that a variety of modifications can be made in the present invention, and it is intended within the appended claims to cover all such modifications as are within the true spirit and scope of the present invention.

What is claimed and desired to be secured by Letters Patent of the United States is:

1. An apparatus for automated box-like frame assembly, the frames including a pair of opposed side portions and a pair of opposed end portions, said portions having interengageable projections and slots along parallel sides thereof, said apparatus comprising:

means for supplying frame end portions, one at a time;

means for supplying frame side portions, one at a time;

means for holding a pair of said frame side portions in spaced apart relation ready for receiving a first frame end portion moved into engagement therewith;

reciprocating means for sliding said first end portions one at a time into engagement with said spaced apart pair of side portions and for sliding said engaged side portions and first end portion into engagement with a second end portion to complete a frame; and means for driving fasteners to fix said side portions to said engaged end portions of a frame.

2. The apparatus of claim 1 wherein said frame side portion supplying means includes a bin capable of storing a plurality of frame sides, and further including automatic means for refilling said frame side portion supplying means.

3. The apparatus of claim 1 including means for automatically applying glue to said frame portions before said driving means fixes said portions together.

4. The apparatus of claim 1 wherein said frame end portions supplying means includes a bin arranged to store said frame end portions in a vertical stack and to feed said frame end portions by gravity.

5. The apparatus of claim 1 wherein said frame end portion supplying means includes a means for pushing said side portions toward said end portion.

6. The apparatus of claim 1 wherein said frame end portions supplying means is located in an elevated position with respect to said frame side portion supplying means, said reciprocating means including a pair of sliders slideable in tracks with respect to said frame end portion supplying means and said frame side portion supplying means, said reciprocating means operable to slide one of said first end portions into engagement with a pair of opposed side portions and to thereafter slide said engaged first end portion and side portions into engagement with said second end portion.

7. The apparatus of claim 6 including a rack for supporting said first end portions in an elevated position with respect to said side portions until such time as said first end portion is engaged with said side portions.

8. The apparatus of claim 7 including means for applying glue to said first end portion before engagement with said side portions.

9. The apparatus of claim 8 including means for applying glue to those edges of said side portions arranged to engage said second end portion, before said side portions are slid into engagement with said second end portion.

10. The apparatus of claim 1 wherein said side portion supplying means includes two spaced apart bins, said driving means including two spaced apart fastening stations, one of said fastening stations and one of said bins being movably positionable with respect to the other fastening station and bin.

* * * * *